US007878503B2

(12) United States Patent
Deckard

(10) Patent No.: US 7,878,503 B2
(45) Date of Patent: Feb. 1, 2011

(54) ALIGNMENT OF MEDIA SHEETS IN AN IMAGE FORMING DEVICE

(75) Inventor: Aaron Don Deckard, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 230 days.

(21) Appl. No.: 11/871,517

(22) Filed: Oct. 12, 2007

(65) Prior Publication Data

US 2009/0096155 A1 Apr. 16, 2009

(51) Int. Cl.
*B65H 7/02* (2006.01)

(52) U.S. Cl. ..... 271/228; 271/272

(58) Field of Classification Search ..... 271/228, 271/246, 252, 272

See application file for complete search history.

(56) References Cited

U.S. PATENT DOCUMENTS 6,866,260 B2 * 3/2005 Williams et al. ..... 271/227
2006/0033262 A1 * 2/2006 Stemmle ..... 271/258.01

* cited by examiner

*Primary Examiner*—Richard W Ridley
*Assistant Examiner*—Michael C McCullough
(74) *Attorney, Agent, or Firm*—David Kalish; John Victor Pezdek

(57) ABSTRACT

Methods and devices for aligning a media sheet in a media feed path of an image forming device. One embodiment includes a drive shaft with skew correction rollers spaced apart on the drive shaft. The media sheet contacts a first skew correction roller and then contacts a second skew correction roller. The drive shaft is then rotated, driving the second skew correction roller and aligning the media sheet to the media feed path.

14 Claims, 11 Drawing Sheets

ALIGNMENT OF MEDIA SHEETS IN AN IMAGE FORMING DEVICE

BACKGROUND

The present application is directed to methods and devices for aligning media sheets in an image forming device, and more specifically to correcting misalignment while the media sheet is conveyed along a media feed path.

Image forming devices, such as a color laser printer, facsimile machine, copier, all-in-one device, etc, move media sheets along a media path. The media sheets initially begin at an input tray that is sized to hold a stack of sheets. Each sheet is individually picked from the stack and introduced into the media path. Due to variability in loading the media sheets into the input tray, as well as dimensional tolerances in the media sheets and the input tray, the media sheets in the input tray may not be consistently and properly aligned. This may cause skewing of the media sheets relative to the media path, which may result in print defects. Misalignment may occur in the scan directions (i.e., left and right), as well as the process directions (i.e., forward and backward).

Additionally, the movement of the media sheets from the input area and along the media path should occur without media jams. Media jams require the user to determine the location of the jam, access and remove the jammed sheet(s), and restart the image formation process. Media jams may be caused by misaligned media sheets.

Current methods and devices to correct media sheet misalignment include forcing the leading edge against a gate or roller nip. If the media sheet is misaligned, a leading corner of the leading edge of the media sheet is delayed at the gate or nip. As the sheet is continued to be conveyed by upstream drive rollers, the media sheet buckles and a remaining portion of the leading edge comes into alignment with the leading corner. This method causes a delay in the forward motion of the media sheet, thus limiting the throughput.

SUMMARY

The present application is directed to methods and devices for aligning a media sheet in a media feed path of an image forming device. One embodiment includes a drive shaft with skew correction rollers spaced apart on the drive shaft. The media sheet contacts a first skew correction roller and then contacts a second skew correction roller. The drive shaft is then rotated, driving the second skew correction roller and aligning the media sheet to the media feed path.

DETAILED DESCRIPTION

The present application is directed to methods and devices for aligning media sheets in a media feed path of an image forming device. One embodiment includes a drive shaft with a first skew correction roller and a second skew correction roller spaced apart on the shaft. The skew correction rollers freely rotate at least partially on the drive shaft. A backup roller engages each of the first and second skew correction rollers forming a first and second nip therebetween. A media sheet is fed into the feed path and is driven by a pair of drive rollers. The media sheet is conveyed along the media feed path and contacts the first skew correction roller nip, and then contacts the second skew correction roller nip. The drive shaft is then rotated, driving the second skew correction roller and aligning the media sheet to the media feed path.

Figure 1:
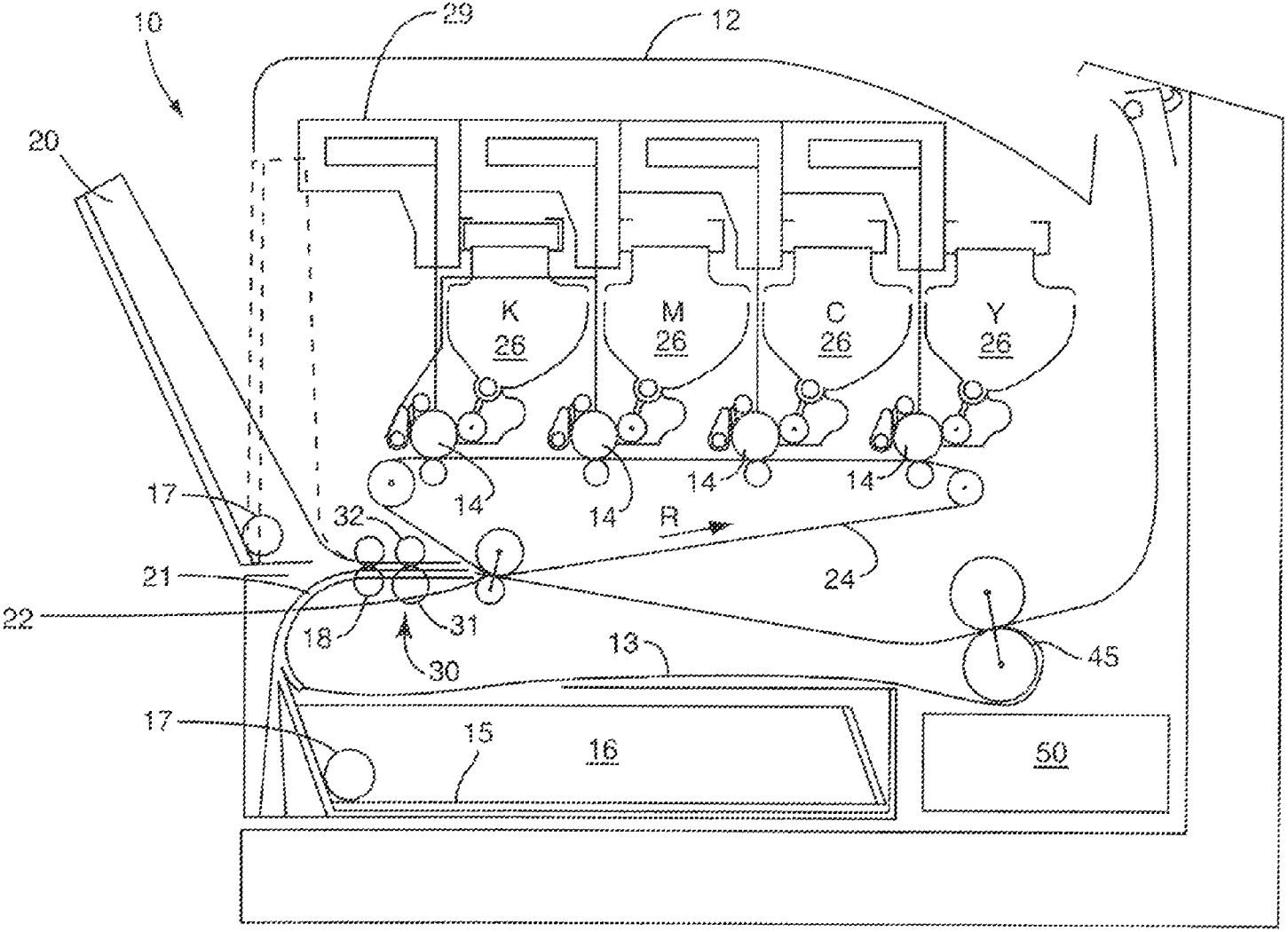
FIG. 1 is a schematic diagram of an image forming device according to one embodiment.

To understand the workings and context of the present application, FIG. 1 depicts a representative image forming device, indicated generally by the numeral 10. The image forming device 10 comprises a main media sheet stack 16. Media sheets 15 may also be introduced through a manual input 20. Within the image forming device body 12, the image forming device 10 may include a plurality of removable image formation cartridges 26, each with a similar construction but distinguished by the toner color contained therein. In one embodiment, the image forming device 10 includes a black cartridge (K), a magenta cartridge (M), a cyan cartridge (C), and a yellow cartridge (Y). Each cartridge 26 forms an individual monocolor image that is combined in layered fashion with images from the other cartridges 26 to create the final multi-colored image. The image forming device 10 may further include an intermediate transfer mechanism (ITM) belt 24, one or more imaging devices 29, and a fuser 45. A controller 50 may oversee operation of the image forming device 10.

The operation of the image forming device 10 is conventionally known. Upon command from the controller 50, the media sheet 15 is "picked," or selected, from either the primary media stack 16 or the manual input 20 by a pick roller 17 and conveyed into a media feed path 21. Regardless of its source, the media sheet 15 is transported to drive rollers 18, and then to transfer location 22 to receive a toner image from the ITM belt 24. The ITM belt 24 is endless and rotates in the direction indicated by arrow R around a series of rollers adjacent to the photoconductor drums 14 of the respective image formation cartridges 26. Toner is deposited from each photoconductor drum 14 as needed to create a full color image on the ITM belt 24. The deposited toner is transferred from the ITM belt 24 to the media sheet 15 at the transfer location 22. The media sheet 15 and attached toner next travel through a fuser 45 having a pair of rollers and a heating element that heats and fuses the toner to the media sheet 15. The media sheet 15 with fused image is then transported out of the printer body 12 for receipt by a user. Alternatively, the media sheet 15 is moved through a duplex path 13 for receiving an image on a second side.

In the image forming device 10 illustrated in FIG. 1, the image is formed on the ITM belt 24 and is subsequently transferred to a media sheet 15 at the secondary transfer location 22. Other image forming devices 10 may use an intermediate transfer drum instead of an ITM belt 24. In other conventional image forming devices 10, media sheets 15 are transported by a transfer belt similar in configuration to the ITM belt 24, but a full color image is formed directly on the media sheet 15 by successively transferring images from the four respective image formation cartridges 26 onto the media sheet 15.

Figure 2:
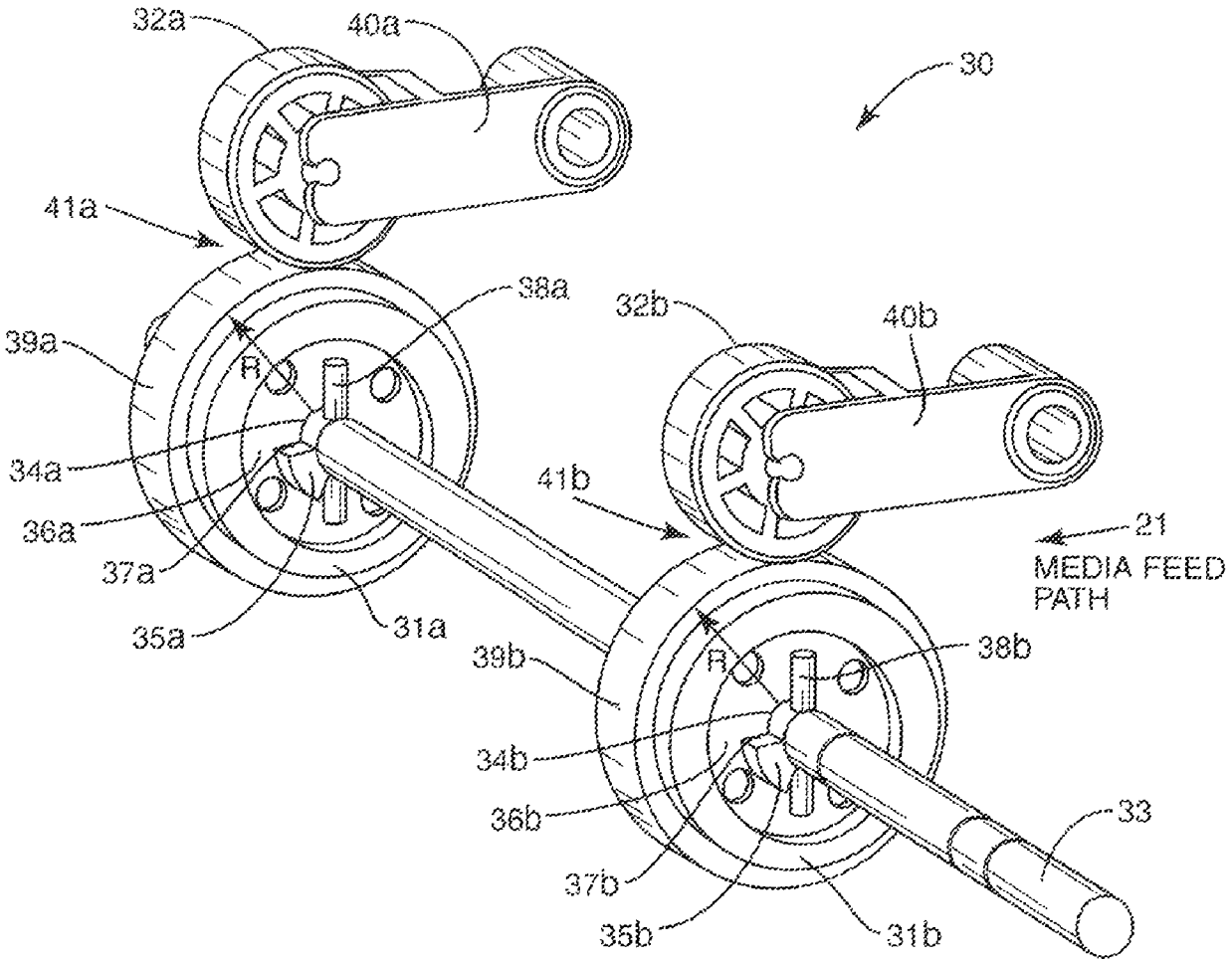
FIG. 2 is a perspective view of skew correction rollers and backup rollers according to one embodiment.

As illustrated in FIG. 1, a media sheet alignment apparatus 30 including skew correction rollers 31 is positioned along the media feed path 21 and may function to align the media sheets 15 prior to image transfer. As best illustrated in FIG. 2, one embodiment of the media sheet alignment apparatus 30 includes a drive shaft 33 positioned perpendicular to the media feed path 21. The drive shaft 33 is operatively connected to a drive motor M (see FIG. 3) and is held stationary when not rotated by the drive motor M. First and second skew correction rollers 31*a*, 31*b* are spaced apart on the drive shaft 33 and are positioned to contact the media sheet 15 as the media sheet 15 is conveyed along the media path 21. Each skew correction roller 31*a*, 31*b* freely rotates about the drive shaft 33 through a predetermined radial amount less than a full rotation.

In one embodiment, each skew correction roller 31*a*, 31*b* includes a radius R selected to position an outer surface 39*a*, 39*b* of the skew correction roller 31*a*, 31*b* within the media feed path 21. The skew correction rollers 31*a*, 31*b* also includes a central axial bore 34*a*, 34*b* sized to allow the drive shaft 33 to be inserted therein while allowing free rotation of the skew correction rollers 31*a*, 31*b* at least partially about the drive shaft 33. The skew correction rollers 31*a*, 31*b* includes tabs 35*a*, 35*b* extending outward from side surfaces 36*a*, 36*b* located adjacent to the central axial bores 34*a*, 34*b*. Each tab 35*a*, 35*b* extends outward from the side surface 36*a*, 36*b* and forms drive receiving surfaces 37*a*, 37*b*.

The drive shaft 33 includes engagement surfaces 38*a*, 38*b*. In the embodiment illustrated in FIG. 2, the engagement surfaces 38*a*, 38*b* comprise a pin extending radially outward from an outer surface of the drive shaft 33. The engagement surfaces 38*a*, 38*b* are positioned to engage the drive receiving surfaces 37*a*, 37*b* of the tabs 35*a*, 35*b*. The engagement surfaces 38*a*, 38*b* rotate along with the drive shaft 33. The engagement surfaces 38*a*, 38*b* contact the drive receiving surfaces 37*a*, 37*b* and drive the skew correction rollers 31*a*, 31*b* for rotational movement.

Outer surfaces 39*a*, 39*b* of the skew correction rollers 31*a*, 31*b* may be comprised of a resilient material selected to reduce slippage between the skew correction rollers 31*a*, 31*b* and the media sheet 15 as the skew correction rollers 31*a*, 31*b* are driven by the drive shaft 33. The outer surfaces 39*a*, 39*b* may be constructed of a different material than the rest of the skew correction rollers 31*a*, 31*b*. For example, the outer surfaces 39*a*, 39*b* may be constructed of a rubber material for gripping ability and the skew correction rollers 31*a*, 31*b* constructed of a rigid thermoplastic material for structural strength.

FIG. 2 also illustrates an embodiment including first and second backup rollers 32*a*, 32*b* positioned to rotatably engage the first and second skew correction rollers 31*a*, 31*b*. Each backup roller 32*a*, 32*b* is mounted to an end of a pivoting arm 40*a*, 40*b* slidably engaged with a mounting shaft (not shown). The slidable engagement allows the backup rollers 32*a*, 32*b* to be repositioned to correspond to a position of the skew correction rollers 31*a*, 31*b*. The backup rollers 32*a*, 32*b* and skew correction rollers 31*a*, 32*b* form nips 41*a*, 41*b* into which the media sheet 15 is fed. The backup rollers 32*a*, 32*b* are urged toward the skew correction rollers 31*a*, 31*b* by, for example, a spring (not shown).

Figure 3:
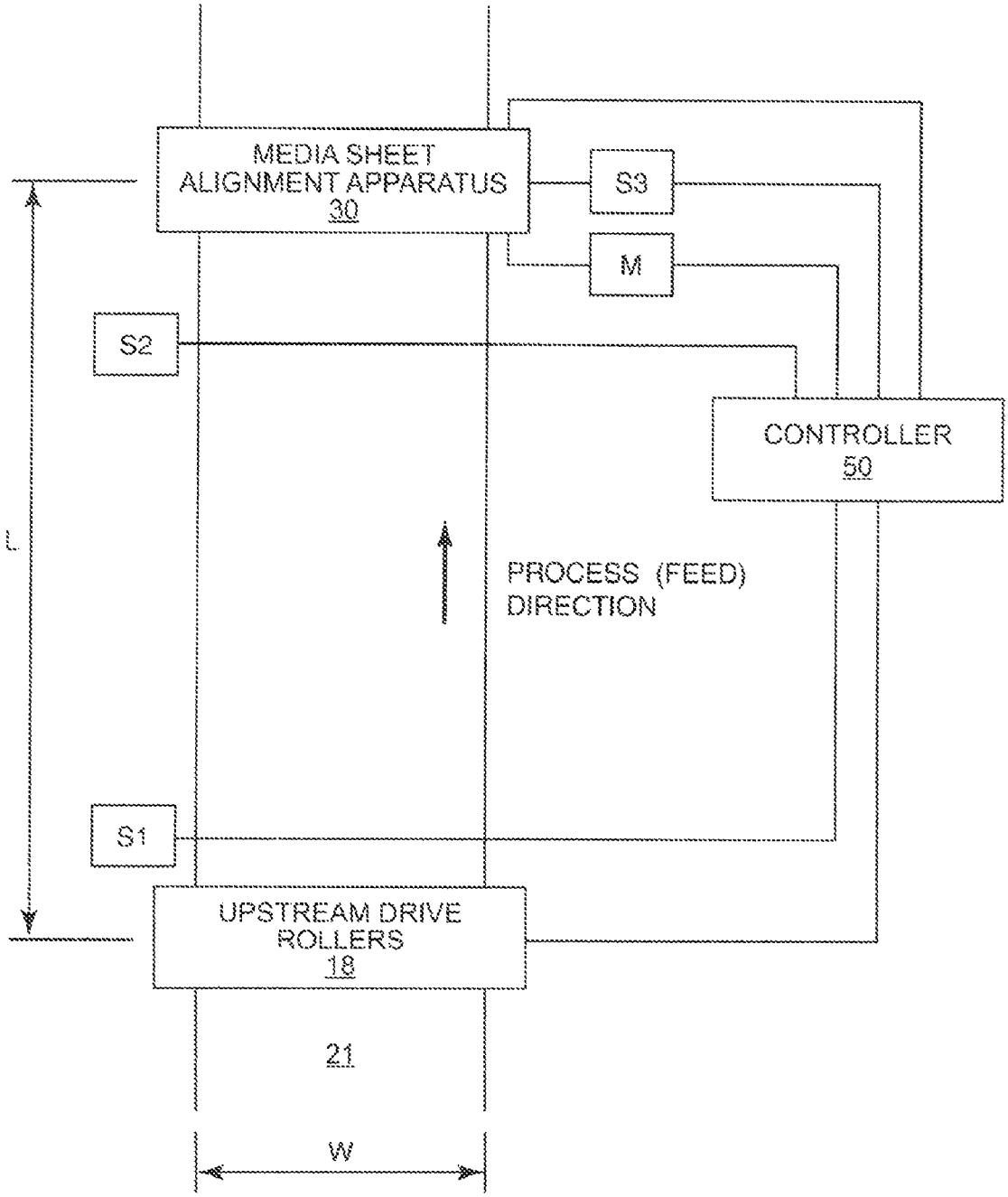
FIG. 3 is a schematic drawing of a media feed path according to one embodiment.

FIG. 3 schematically illustrates one embodiment of the relationship between the controller 50, the media sheet alignment apparatus 30, and a variety of sensors S1, S2, S3 that may monitor the media feed path 21. Controller 50 may oversee the timing of the toner image formation and the media sheet 15 to ensure the two coincide and are properly aligned at the transfer location 22. In one embodiment, controller 50 includes a microprocessor, random access memory, read only memory, a clock, and in input/output interface (not shown). The controller 50 may monitor a variety of sensors along the media feed path 21 to determine a location of the media sheet 15 and the status of rollers and drive motors.

FIG. 3 illustrates a width W of the media feed path 21. The width W is measured in the scan direction, and is perpendicular to the process (feed) direction of the media path 21. The width W of the media path 21 may be slightly larger than a width of the media sheet 15 to allow for some amount of misalignment of the media sheet 15 without jamming. In one embodiment, a length L between the media sheet alignment apparatus 30 and the first set of drive rollers 18 upstream of the media sheet alignment apparatus 30 may be equal to or slightly greater than a length of a media sheet 15. In another embodiment, the length L is less than a length of a media sheet 15, which may allow the media sheet to be positioned simultaneously in the nip of the upstream drive rollers 18 and one or both of the nips 41*a*, 41*b* of the skew correction rollers 31*a*, 31*b*.

The sensors S1, S2, S3 may be placed along the media feed path 21 to determine the position of the media sheet. In one embodiment, the sensors S1, S2, S3 are optical sensors that detect a leading edge 11 or trailing edge of the media sheet when passing the sensor location. In another embodiment, the sensors S1, S2, S3 are optical encoders that sense the amount of rotation of drive motors. Once the controller 50 determines the position of the leading edge 11 of media sheet 15, the controller may then be able to calculate the position of the leading edge at any time using known values for the speed of the media sheet 15 and known distances within the media feed path 21, such as the length L between the drive rollers 18 and the media sheet alignment apparatus 30.

Optical encoders may also be used to determine when a non-driven roller rotates, which may indicate that the leading edge 11 of the media sheet 15 has reached the roller. For example, sensor S3 may sense the rotation of one or more of the backup rollers 32*a*, 32*b*. Rotation of both backup rollers 32*a*, 32*b* as illustrated in FIG. 2 may indicate that an entire leading edge 11 of the media sheet 15 is within the skew correction roller nips 41*a*, 41*b*, and the controller 50 may then activate the drive motor M. It will be apparent to those skilled in the art that the sensors S1, S2, S3 may function independently or in some combination. It will also be apparent that either a greater or lesser number of sensors may be used to monitor the media feed path 21, and the three sensors S1, S2, S3 illustrated in FIG. 3 are exemplary and do not serve to limit the present application in any manner.

Figure 4:
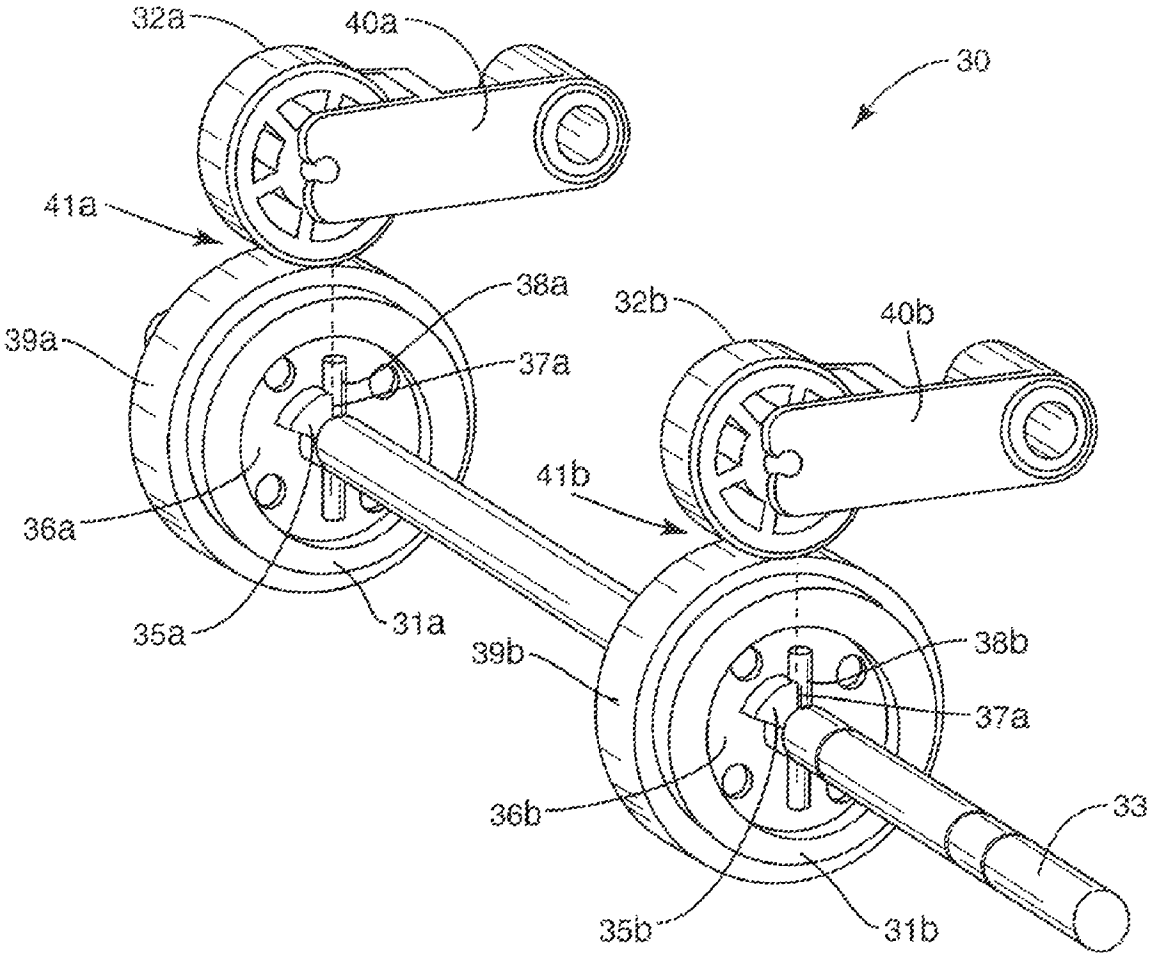
FIG. 4 is a perspective view of skew correction rollers and backup rollers according to one embodiment.

The operation of the media sheet alignment apparatus 30 according to one embodiment is illustrated in FIGS. 4-8. FIG. 4 illustrates an initial position of the skew correction rollers 31*a*, 31*b* and the drive shaft 33 prior to the media sheet 15 arriving at the media sheet alignment apparatus 30. In the initial position, the drive receiving surfaces 37*a*, 37*b* of the tabs 35*a*, 35*b* on the skew correction rollers 31*a*, 31*b* are in contact with the engagement surfaces 38*a*, 38*b* of the drive shaft 33. At this point, there is no separation between the drive receiving surfaces 37*a*, 37*b* and the engagement surfaces 38*a*, 38*b* as indicated by the broken lines in FIG. 4. The drive motor M for the drive shaft 33 is not activated at this point, and the drive shaft 33 is held stationary. Although FIG. 4 illustrates that the engagement surfaces 38*a*, 38*b* are in an essentially vertical position, any radial position is acceptable for the initial position so long as the engagement surfaces 38*a*, 38*b* and the drive receiving surfaces 37*a*, 37*b* are in contact with one another.

Figure 5:
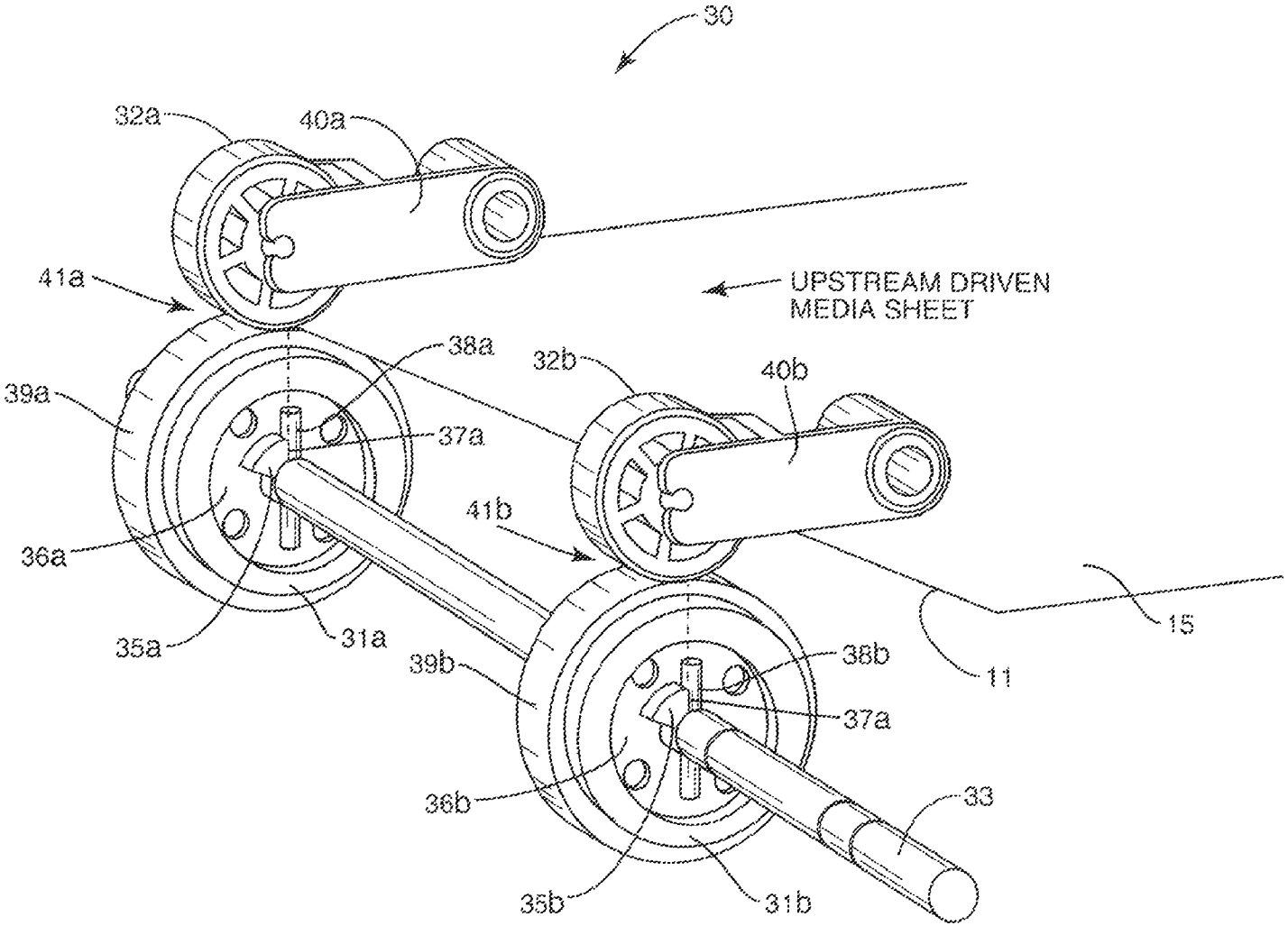
FIG. 5 is a perspective view of skew correction rollers, backup rollers, and a misaligned media sheet according to one embodiment.

FIG. 5 illustrates the media sheet 15 arriving at the media sheet alignment apparatus 30. The media sheet 15 is being driven by the upstream drive rollers 18. The leading edge 11 of the media sheet 15 is immediately in front of the first nip 41*a*, but has not yet entered the first nip 41*a*. The leading edge 11 is spaced apart from the second nip 41*b*. This indicates that the media sheet 15 is misaligned with the media feed path 21. In other words, a longitudinal axis of the media sheet 15 in the process direction is not aligned with (i.e., not parallel to) an axis along the media feed path 21 in the process direction. At this point, the drive motor M for the drive shaft 33 is not activated.

Figure 6:
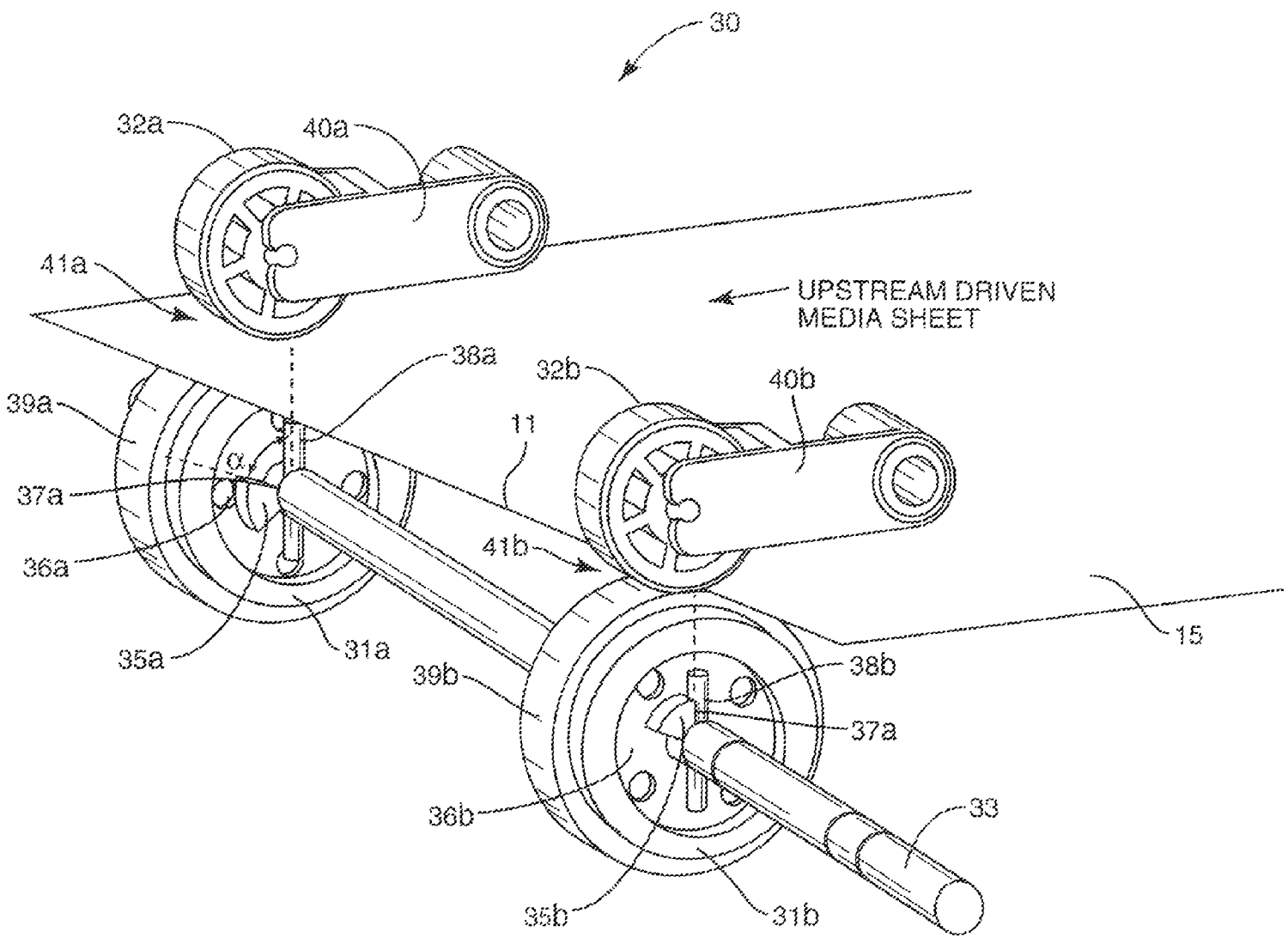
FIG. 6 is a perspective view of skew correction rollers, backup rollers, and a misaligned media sheet according to one embodiment.

In FIG. 6, the media sheet 15 has now traveled such that the leading edge 11 is no longer spaced apart from the second nip 41*b*, but has not yet entered the second nip 41*b*. The leading edge 11 has passed through the first nip 41*a*, and the media sheet 15 extends past the first skew correction roller 31*a*. As the media sheet 15 passes through the first nip 41*a*, the first skew correction roller 31*a* rotates about the drive shaft 33, which is still held stationary. The amount of rotation of the first skew correction roller 31*a* is illustrated by the two broken lines in FIG. 6. One of the broken lines (the horizontal broken line) represents the initial position and corresponds to the position of the first engagement surface 38*a*. The other broken line corresponds to the position of the first drive receiving surface 37*a* after the first skew correction roller 31*a* has rotated as a result of the media sheet 15 passing through the first nip 41*a*. An amount of rotation $\alpha$ is the measure of the angle between the two broken lines.

Figure 7:
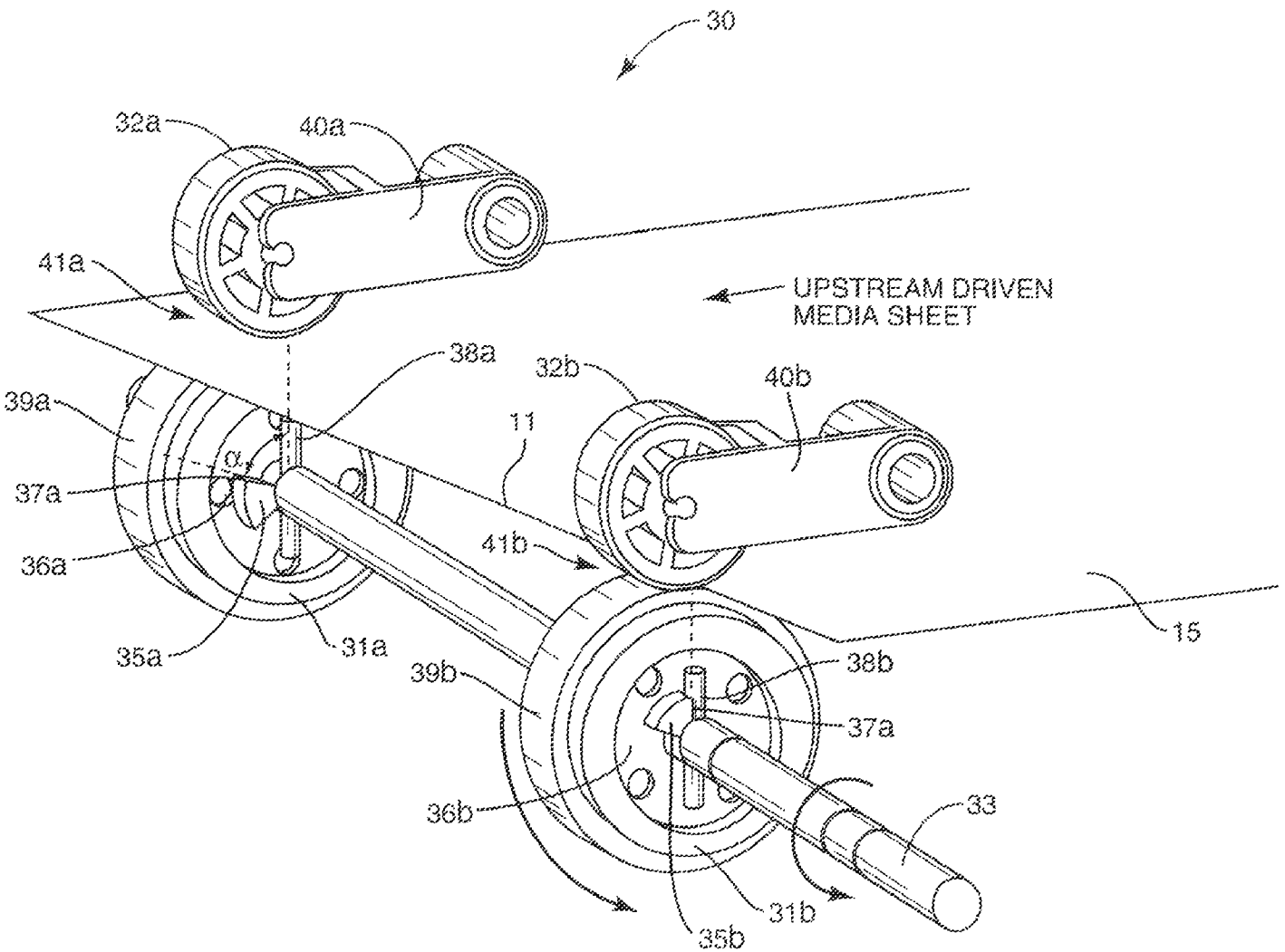
FIG. 7 is a perspective view of skew correction rollers, backup rollers, and a misaligned media sheet according to one embodiment.

In FIG. 7, the media sheet 15 is now within both the first and second nips 41*a*, 41*b*. The drive motor M for the drive shaft 33 is now activated, and the movement of the media sheet 15 along the media feed path 21 is taken over by the media sheet alignment apparatus 30. As the drive shaft 33 begins to turn, the second engagement surface 38*b* is in contact with the second drive receiving surface 37*b* of the second skew correction roller 31*b*. This contact causes the second skew correction roller 31*b* to be rotated by the drive shaft 33. Because of the existing separation between the first engagement surface 38*a* and the first drive receiving surface 37*a* of the first skew correction roller 31*a*, the first skew correction roller 31*a* is not driven at this point and remains essentially stationary.

Figure 8:
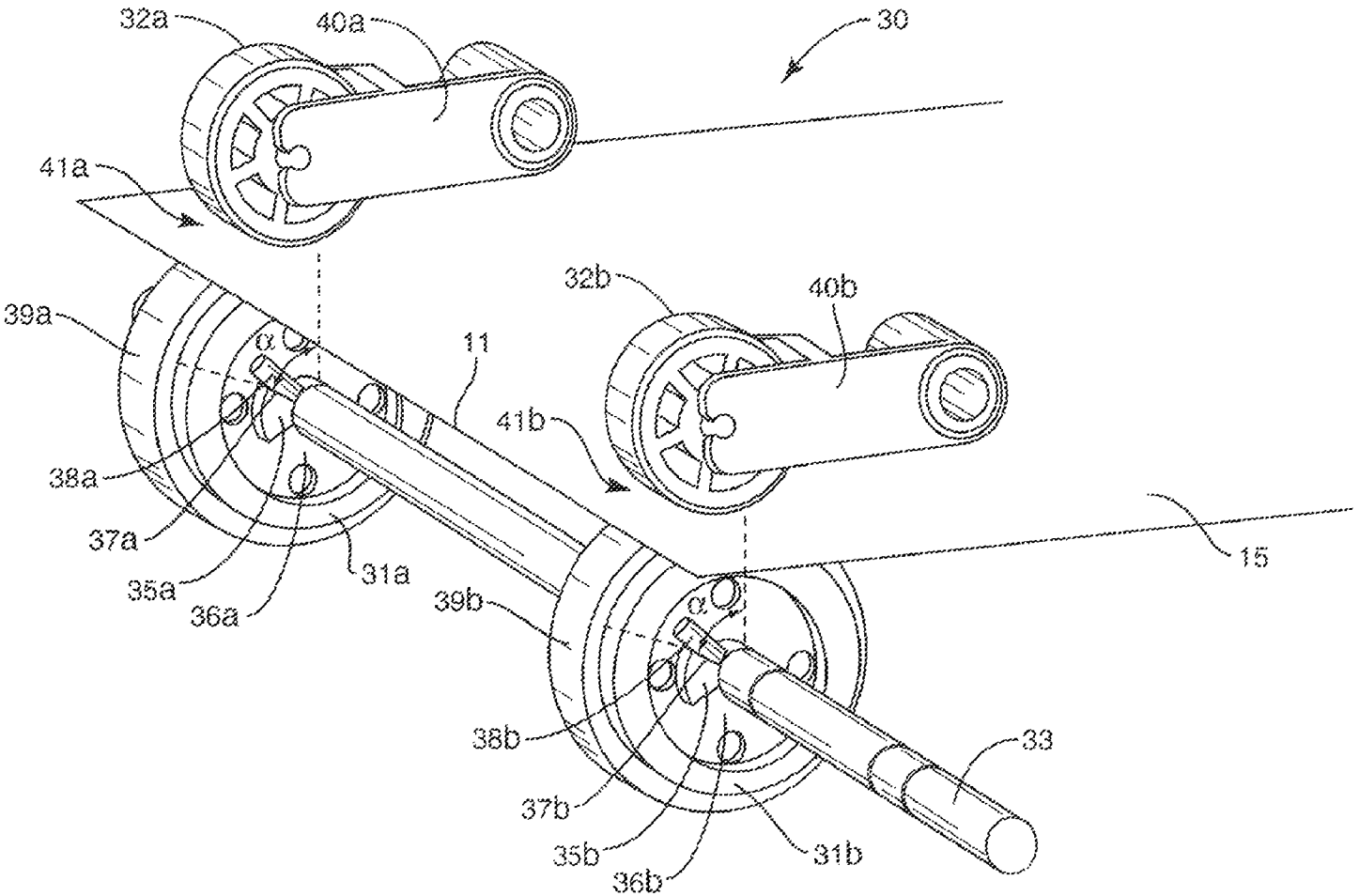
FIG. 8 is a perspective view of skew correction rollers, backup rollers, and an aligned media sheet according to one embodiment.

In FIG. 8, the drive shaft 33 has continued to drive the second skew correction roller 31*b* until the amount of rotation a equals the amount of rotation a of the first skew correction roller 31*a*. While the second skew correction roller 31*b* rotates through the amount of rotation $\alpha$, the first skew correction roller 31*a* remains essentially stationary. This allows the second skew correction roller 31*b* to solely drive the media sheet 15. Because the media sheet 15 is held essentially in place at the first nip 41*a* while the second skew correction roller 31*b* is driven by the drive shaft 33, the media sheet 15 moves toward alignment with the media feed path 21. As the media sheet 15 approaches proper alignment, the first engagement surface 38*a* "catches up" with the first drive receiving surface 37*a*, and the drive shaft 33 begins to drive the first skew correction roller 31*a* simultaneously with the second skew correction roller 31*b*. The media sheet 15 is then driven evenly down the media feed path 21 in its realigned orientation.

Figure 9:
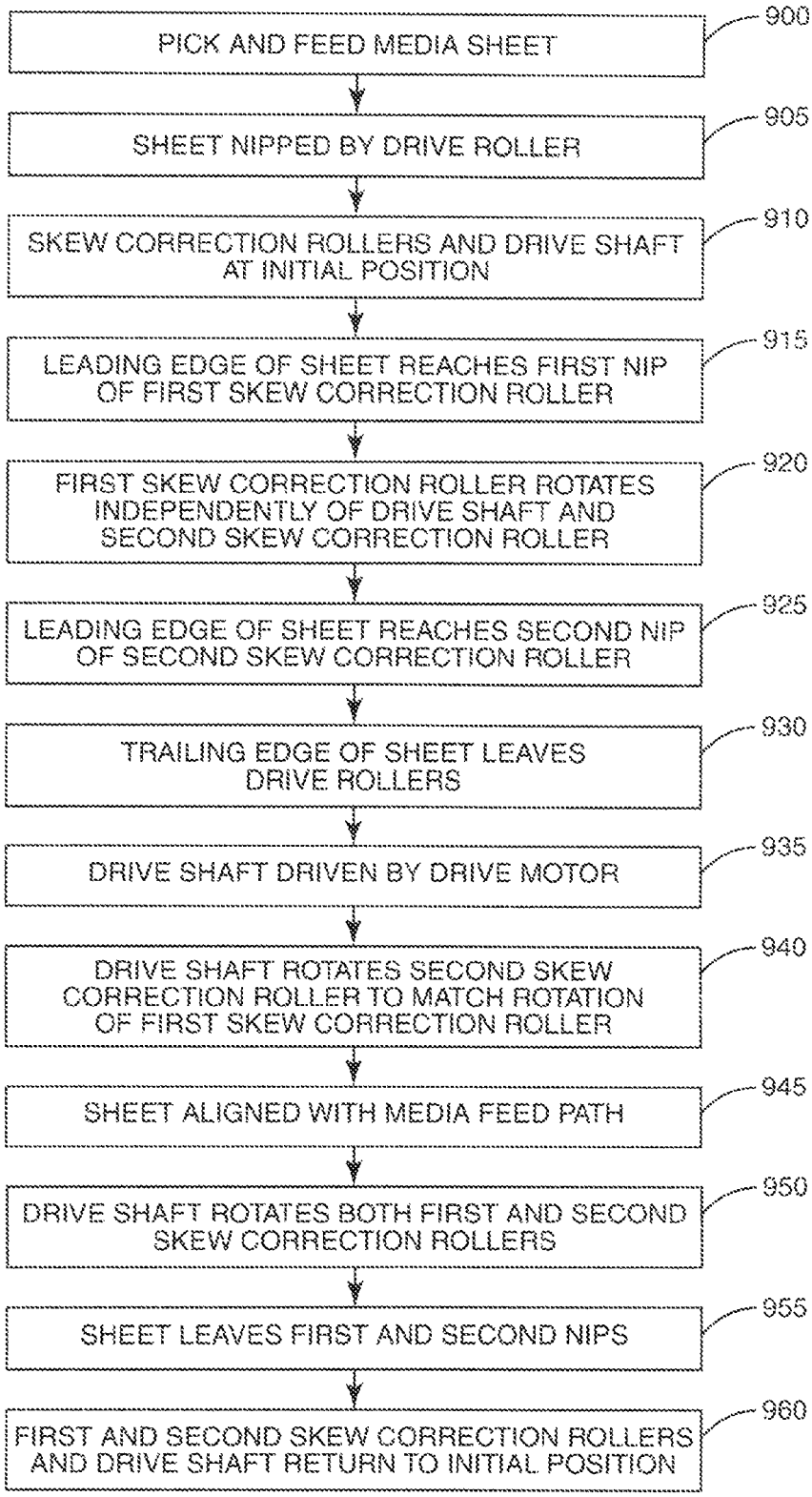
FIG. 9 is a process diagram for a media sheet alignment process according to one embodiment.

The overall operation of the media sheet alignment apparatus 30 is illustrated by the flow chart of FIG. 9. Initially, the image forming device 10 picks and feeds the media sheet 15 from the primary media stack 16 or the manual input 20 and conveys the media sheet 15 to the media feed path 21 (step 900). The media sheet 15 is then nipped by the drive rollers 18 and conveyed along the media feed path 21 (step 905). At this point, the skew correction rollers 31 and the drive shaft 33 of the media sheet alignment apparatus 30 are at the initial position (step 910). The initial position comprises both drive receiving surfaces 37*a*, 37*b* in contact with the corresponding engagement surfaces 38*a*, 38*b*.

As the drive rollers 18 continue to convey the media sheet 15 along the media feed path 21, the leading edge 11 of the media sheet 15 reaches the first skew correction roller 31*a* and enters the first nip 41*a* (step 915). The media sheet 15 progresses through the first nip 41*a*, causing the first skew correction roller 31*a* to rotate on the drive shaft 33 (step 920). At this point, the second skew correction roller 31*b* and the drive shaft 33 are stationary. Next, the leading edge 11 of the media sheet 15 reaches the second nip 41*b* (step 925). The trailing edge of the media sheet 15 may now exit the nip of the drive rollers 18 (step 930), and the drive motor M operatively connected to the drive shaft 33 is activated by the controller 50 (step 935).

Because the second drive receiving surface 37*b* is still in contact with the second engagement surface 38*b*, the drive shaft 33 rotates the second skew correction roller 31*b* (step 940). The drive shaft 33 does not yet rotate the first skew correction roller 31*a* because media sheet 15 has partially rotated the first skew correction roller 31*a*, separating the first drive receiving surface 37*a* from the first engagement surface 38*b*. The drive shaft 33 continues to rotate the second skew correction roller 31*b* while the first skew correction roller 31*a* remains essentially stationary causing the media sheet 15 to at least partially realign with the media feed path 21 (step 945).

At about the point where the media sheet 15 is properly aligned with the media feed path 21, the rotation of the drive shaft 33 has caused the first engagement surface 38*a* to catch up with the first drive receiving surface 37*a*. The drive shaft 33 now drives both the first and second skew correction rollers 31*a*, 31*b* (step 950) and conveys the aligned media sheet 15 out of the first and second nips 41*a*, 41*b* (step 955). The controller 50 then deactivates the drive motor M, stopping the drive shaft 33 and the first and second skew correction rollers 31*a*, 31*b* in the initial position ready for the next media sheet 15 (step 960).

Figure 10:
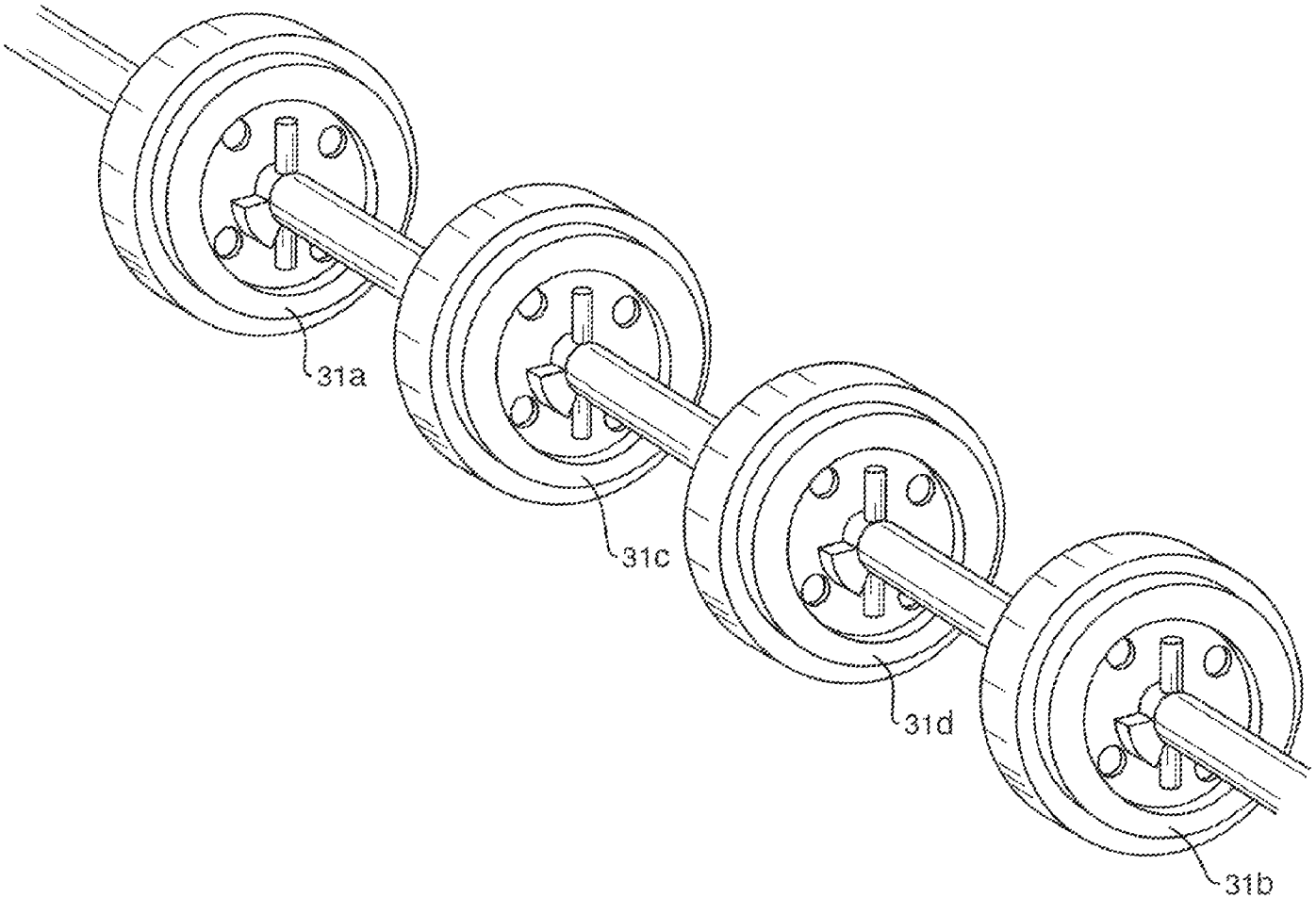
FIG. 10 is a perspective view of a drive shaft and a plurality of skew correction rollers according to one embodiment.

In one embodiment, the skew correction rollers 31*a*, 31*b* are spaced apart on the drive shaft 33 a distance approximately equal to the width W of the media feed path 21. In another embodiment, the skew correction rollers 31*a*, 31*b* are spaced apart a distance less than the width W of the media feed path 21. In one embodiment, the distance between the skew correction rollers 31*a*, 31*b* is adjustable to accommodate media sheets 15 of a variety of widths. For example, the skew correction rollers 31*a*, 31*b* may be spaced a relatively short distance apart when the media sheets 15 are narrow, such as envelopes. In one embodiment as illustrated in FIG. 10, the media sheet alignment apparatus 30 comprises more than two skew correction rollers 31*a*-31*d*. In this embodiment, all four skew correction rollers 31*a*-31*d* may operatively correct the alignment of a media sheet 15 having a width approximately the same as the media feed path width W. However, less than all four of the skew correction rollers 31*a*-31*d* may operatively correct the alignment of more narrow media sheets 15, such as envelopes. The skew correction rollers 31*a*-31*d* may be evenly spaced across the drive shaft 33, or may be variably spaced.

Figure 11:
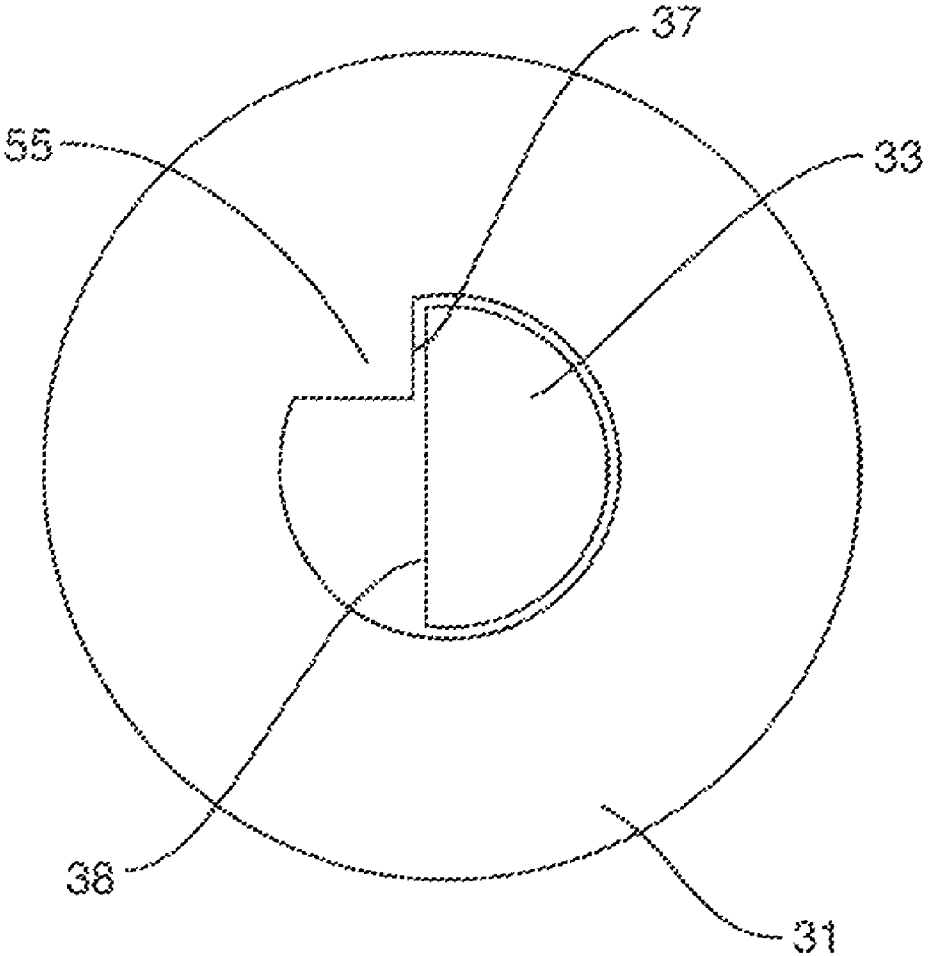
FIG. 11 is a schematic view of a drive shaft and skew correction roller according to one embodiment.

As illustrated in FIG. 2, the engagement surface 38 comprises a pin or other projection extending outward from the outer surface of the drive shaft 33, and the drive receiving surface 37 comprises a tab 35 extending outward from a side surface 36 of the skew correction roller 31. This arrangement is exemplary, and other arrangements that allow the skew correction roller 31 to freely rotate partially about the drive shaft 33 as are known in the art are also contemplated. For example, FIG. 11 illustrates a D-shaped drive shaft 33 wherein a flat surface on the drive shaft 33 may be the engagement surface 38. The central bore 34 of the skew correction roller may include a notch 55 or other projection extending into the bore 34 that may include the drive engagement surface 37.

FIG. 2 illustrates one embodiment including each backup roller 32 independently mounted on a pivot arm 40. Alternatively, the backup rollers 32 may be mounted on a common shaft (not shown) instead of pivot arms. The shaft may be biased by a spring at one or both ends to urge the backup rollers 32 toward the skew correction rollers 31. The shaft and biasing spring may be configured to allow the shaft an amount of movement at one or both ends perpendicular to the process direction. This movement may allow the nip 41 to open slightly in response to a media sheet 15 in the nip 41, or to maintain contact between backup rollers 32 and the skew correction rollers 31 due to slight differences in diameter of the backup rollers 32 and/or skew correction rollers 31.

FIG. 1 illustrates one embodiment where the media sheet alignment apparatus 30 is positioned prior to the secondary transfer location 22. In one embodiment, the media sheet alignment apparatus 30 may be located after the secondary transfer location 22. For example, it may be necessary to maintain alignment of media sheets 15 that are to be imaged on both sides after the first image is fused and before the second image is transferred to the media sheet 15. Thus, the media sheet alignment apparatus 30 may be located downstream from the fuser 45 to align the media sheet 15 prior to returning the media sheet 15 for the second image transfer. Other locations of the media sheet alignment apparatus 30 in the media feed path 21 as desired for a particular application are also contemplated.

FIG. 1 illustrates a color laser printer as the image forming device 10 with a secondary transfer structure (i.e., the toner image is initially transferred to the ITM 24 and then at the secondary transfer location 22 to the media sheet 15). The present application may also be used in a variety of other color laser printers, including those with direct toner transfer to the media sheet 15. The present application may also be used in a variety of other image forming devices 10 including but not limited to facsimile machines, copiers, all-in-one devices, etc.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A media sheet conveying apparatus to align a misaligned media sheet moving along a media feed path in an image forming device, comprising:

a drive shaft extending along at least a section of the media feed path; and a first skew correction roller and a second skew correction roller spaced apart on the drive shaft and each positioned within the media feed path, the first and second skew correction rollers operative to each independently rotate about the drive shaft when the drive shaft is stationary;

wherein the drive shaft when driven rotates the second skew correction roller a radial amount to align the media sheet prior to rotating the first skew correction roller, and wherein the first and second skew correction rollers each include a drive receiving surface, and the drive shaft includes engagement surfaces aligned with each drive receiving surface, the engagement surfaces adapted to rotate with the drive shaft and engage the drive receiving surfaces, thereby rotationally driving the first and second skew correction rollers.

2. The media sheet conveying apparatus of claim 1, further comprising first and second backup rollers rotationally engaged with the first and second skew correction rollers forming nips therebetween.

3. The media sheet conveying apparatus of claim 2, wherein each backup roller is rotatably attached to an arm, the arm configured to allow pivoting movement of the backup roller.

4. The media sheet conveying apparatus of claim 1, wherein each engagement surface comprises a pin projecting radially outward from an outer surface of the drive shaft.

5. The media sheet conveying apparatus of claim 1, wherein each drive receiving surface comprises a projection extending outward from a side surface of each of the first and second skew correction rollers, each projection including an essentially flat surface adapted to engage the engagement surface.

6. The media sheet conveying apparatus of claim 1, wherein the drive receiving surface of the second skew correction roller is positioned adjacent to one of the engagement surfaces, the second skew correction roller rotating when the drive shaft rotates.

7. The media sheet conveying apparatus of claim 1, wherein a radius of the first skew correction roller is approximately the same as the radius of the second skew correction roller.

8. The media sheet conveying apparatus of claim 1, further comprising at least one additional skew correction roller positioned on the drive shaft between the first and second skew correction rollers.

9. A method of aligning a misaligned media sheet moving along a media feed path in an image forming device, comprising:

moving the misaligned media sheet along the media feed path;

extending a drive shaft across at least a section of the media feed path, the drive shaft including a first skew correction roller and a second skew correction roller rotatably mounted thereon;

positioning the drive shaft and the first and second skew correction rollers at an initial position where a first drive receiving surface on the first skew correction roller is in contact with a first engagement surface on the drive shaft, and a second drive receiving surface on the second skew correction roller is in contact with a second engagement surface on the drive shaft;

moving a leading edge of the misaligned media sheet along the media feed path and through a first nip between the first skew correction roller and a first backup roller, causing the first drive receiving surface to be spaced apart from the first engagement surface while the drive shaft remains stationary;

moving the leading edge of the misaligned media sheet along the media feed path until the leading edge reaches a second nip between the second skew correction roller and a second backup roller; and rotating the drive shaft while maintaining contact between the second drive receiving surface and the second engagement surface and closing a space between the first drive receiving surface and the first engagement surface, thereby aligning the media sheet with the media feed path.

10. The method of claim 9, further comprising continuing to rotate the drive shaft after closing the space between the first drive receiving surface and the first engagement surface, and causing the first and second engagement surfaces to simultaneously impart a rotational force on the first and second skew correction rollers until the media sheet is moved out of the first and second nips.

11. The method of claim 9, further comprising holding the drive shaft stationary until the leading edge of the misaligned media sheet reaches the second nip.

12. The method of claim 9, wherein rotating the drive shaft aligns a longitudinal axis of the misaligned media sheet approximately with an axis of the feed path along a process direction.

13. The method of claim 9, wherein the first drive receiving surface is spaced apart from the first engagement surface by less than a full rotation.

14. The method of claim 9, further comprising rotating the drive shaft and the first and second skew correction rollers to an initial position after the media sheet moves out of the first and second nips.

* * * * *